US006899068B2

(12) United States Patent
Nan et al.

(10) Patent No.: US 6,899,068 B2
(45) Date of Patent: May 31, 2005

(54) HYDRAULIC VALVE ACTUATION SYSTEM

(75) Inventors: Xinshuang Nan, Bloomington, IL (US); Sean Olen Cornell, Gridley, IL (US); Scott Alan Leman, Eureka, IL (US)

(73) Assignee: Caterpillar Inc, Peoria, IL (US)

( * ) Notice: Subject to any disclaimer, the term of this patent is extended or adjusted under 35 U.S.C. 154(b) by 102 days.

(21) Appl. No.: 10/259,599

(22) Filed: Sep. 30, 2002

(65) Prior Publication Data

US 2004/0060529 A1 Apr. 1, 2004

(51) Int. Cl.[7] ..... F01L 9/02

(52) U.S. Cl. ..... 123/90.12; 123/90.14; 123/90.15

(58) Field of Search ..... 123/90.12, 90.13, 123/90.11, 90.14, 90.15; 251/30.1, 30.2, 30.3, 30.4, 30.5

(56) References Cited

U.S. PATENT DOCUMENTS 4,484,545 A * 11/1984 Madsen ..... 123/90.12
5,255,641 A 10/1993 Schechter
5,497,736 A 3/1996 Miller et al.
5,682,846 A * 11/1997 Scharnweber ..... 123/90.12
6,263,842 B1 7/2001 De Ojeda et al.
6,536,388 B2 * 3/2003 Lou ..... 123/90.12

FOREIGN PATENT DOCUMENTS

EP 0520633 12/1992
EP 0736671 10/1996

* cited by examiner

*Primary Examiner*—Thomas Denion
*Assistant Examiner*—Zelalem Eshete
(74) *Attorney, Agent, or Firm*—Finnegan, Henderson, Farabow, Garrett & Dunner

(57) ABSTRACT

An engine valve actuation system may include an actuation assembly having a body, a slidable piston, and first, second, and third chambers defined between the piston and the body. Low pressure and high pressure fluid sources may be included. A first fluid passage may connect the low pressure fluid source to the second chamber. A second fluid passage may connect the high pressure fluid source to the second chamber, and a third fluid passage may connect the high pressure fluid source to the third chamber. A control valve may be connected to the low pressure fluid source, to the high pressure fluid source, and to the first chamber. The control valve may be configured to move between a first position at which the high pressure fluid source is connected to the first chamber, and a second position at which the low pressure fluid source is connected to the first chamber.

21 Claims, 7 Drawing Sheets

HYDRAULIC VALVE ACTUATION SYSTEM

TECHNICAL FIELD

The present invention is directed to an engine valve actuation system and more particularly to a dual pressure hydraulic engine valve actuation system.

BACKGROUND

An internal combustion engine typically includes a plurality of engine valves. These engine valves control the intake and exhaust of gases relative to the combustion chamber(s) of the engine. A typical engine will include at least one intake valve and at least one exhaust valve for each combustion chamber of the engine. The opening of each valve is timed to occur at a predetermined cam or crank shaft angle in the operating cycle of the engine. For example, an intake valve may be opened when a piston is moving from a top-dead-center position to a bottom-dead-center position in its cylinder to pass air into the combustion chamber. The exhaust valve may be opened during the movement of the piston toward top-dead-center to expel an exhaust gas from the combustion chamber.

The actuation, or opening and closing, of the engine valves may be achieved in a number of ways. For example, the engine may drive a crankshaft that is rotatively connected to a cam shaft. Each engine valve may be mechanically actuated by this cam shaft. In addition, the rotation of the crankshaft also may control the reciprocal motion of the combustion chamber piston. Thus, the rotation of the crankshaft mechanically controls and coordinates the timing of actuation of each engine valve with the desired movements of the respective combustion chamber piston.

Mechanically actuating the engine valves, however, provides no flexibility in the timing of valve actuation. It has been found that engine operating characteristics, for example, efficiency, may be improved by varying the timing of the valve actuation based on the operating parameters of the vehicle. With mechanical actuation, the engine valves will be actuated at the same timing angle of crankshaft rotation regardless of the vehicle operating parameters. Thus, these types of inflexible systems may not be capable of optimizing engine performance.

Another approach involves actuating the engine valves independently of the crankshaft rotation. This may be accomplished, for example, with a hydraulic system. As shown in U.S. Pat. No. 6,263,842 to De Ojeda et al., dated Jul. 24, 2001, a hydraulically-driven piston may be used to actuate an engine valve. In this approach, a hydraulic piston is connected to each engine valve and is actuated by the introduction of pressurized fluid. The actuation of the engine valve may, therefore, be controlled independently of the crankshaft rotation and may provide additional flexibility in the valve timing.

To obtain further improvements in engine efficiency, the engine valves may need to be actuated when the gas within the combustion chamber is under pressure. A hydraulically-actuated engine valve, as discussed above, will need to exert a significant force to open the engine valve under these conditions. This may require either a highly pressurized fluid or a valve actuation piston with a large surface area. An additional pump may be required to provide the highly pressurized fluid.

In addition, the hydraulically-actuated engine valve discussed above may not be able to accurately control the amount of engine valve movement during actuation. In a situation where the engine valve is actuated when the combustion chamber piston is advancing within the combustion chamber, the amount of engine valve lift may need to be limited to prevent a collision between the combustion chamber piston and the engine valve. Such a collision may damage the engine valve and prevent the engine valve from properly sealing the gas passageway. This damage may disrupt the operation of the engine.

Furthermore, the hydraulically-actuated valve discussed above may not be able to control the speed of the engine valve during engine valve actuation. Seating an engine valve at high velocity may result in high seating forces that damage the engine valve or the valve seat, thereby preventing the engine valve from properly sealing and reducing the efficient operation of the engine.

In addition, if a high-force hydraulically-actuated engine valve requires a valve actuation piston with a large surface area, a substantial amount of highly pressurized fluid could be required each time the engine valve is actuated. This could significantly decrease the amount of fluid available to other high pressure systems within the vehicle. Moreover, it would be beneficial to recycle at least a part of this highly pressurized fluid so that some of the hydraulic energy used to pressurize this fluid may be recuperated, thereby increasing engine efficiency and reducing parasitic losses.

The valve actuation system of the present invention solves one or more of the problems set forth above.

SUMMARY OF THE INVENTION

One aspect of the present invention is directed to an engine valve actuation system. The system may include an actuation assembly having a body, a piston slidable relative to the body, and first, second, and third chambers defined between the piston and the body. The system may also include low pressure and high pressure fluid sources. A first fluid passage may connect the low pressure fluid source to the second chamber. A second fluid passage may connect the high pressure fluid source to the second chamber, and a third fluid passage may connect the high pressure fluid source to the third chamber. A control valve may be connected to the low pressure fluid source, to the high pressure fluid source, and to the first chamber. The control valve may be configured to move between a first position at which the high pressure fluid source is connected to the first chamber, and a second position at which the low pressure fluid source is connected to the first chamber.

In another aspect, a method to operate a hydraulic valve actuation system is provided. The hydraulic valve actuation system may include a piston, a body, first, second, and third chambers defined between the piston and the body, a low pressure fluid source selectively connected to the first and second chambers, and a high pressure fluid source selectively connected to the first and second chambers and connected to the third chamber. The method may include providing the piston in a first position such that the volume of the second chamber is minimized. Fluid may be passed from the high pressure fluid source to the first chamber, and the piston may be moved in the first direction. Fluid from the third chamber may be passed to the high pressure fluid source in response to the pressure in the third chamber exceeding the pressure in the high pressure fluid source. The method may also include passing fluid from the low pressure fluid source into the second chamber in response to the pressure in the second chamber being less than the pressure in the low pressure fluid source.

In a further aspect, a method to recover energy in an engine valve actuation system connected to a high pressure fluid source is provided. The engine valve actuation system may include a body, a piston capable of moving relative to the body, and first and second volumes defined between the piston and the body. The method includes moving the piston relative to the body in a first direction in response to passing fluid from the high pressure fluid source to the first volume. The method further includes passing fluid from the second volume to the high pressure fluid source in response to moving the piston relative to the body in the first direction.

In another aspect, a method to control a closing force of a valve in an engine valve actuation system connected to a high pressure fluid source is provided. The engine valve actuation system includes a body, a piston capable of moving relative to the body, and first and second volumes defined between the piston and the body. The method includes moving the piston relative to the body in a valve-closing direction in response to passing fluid from the high pressure fluid source into the first volume. The closing force of the valve may be decreased in response to increasing the pressure in a second volume. The method further includes passing fluid from the second volume to the high pressure fluid source in response to the pressure in the second volume exceeding the pressure in the high pressure fluid source.

It is to be understood that both the foregoing general background, the following detailed description, and the drawings are exemplary and explanatory only and are not restrictive of the invention.

DETAILED DESCRIPTION

Figure 1:
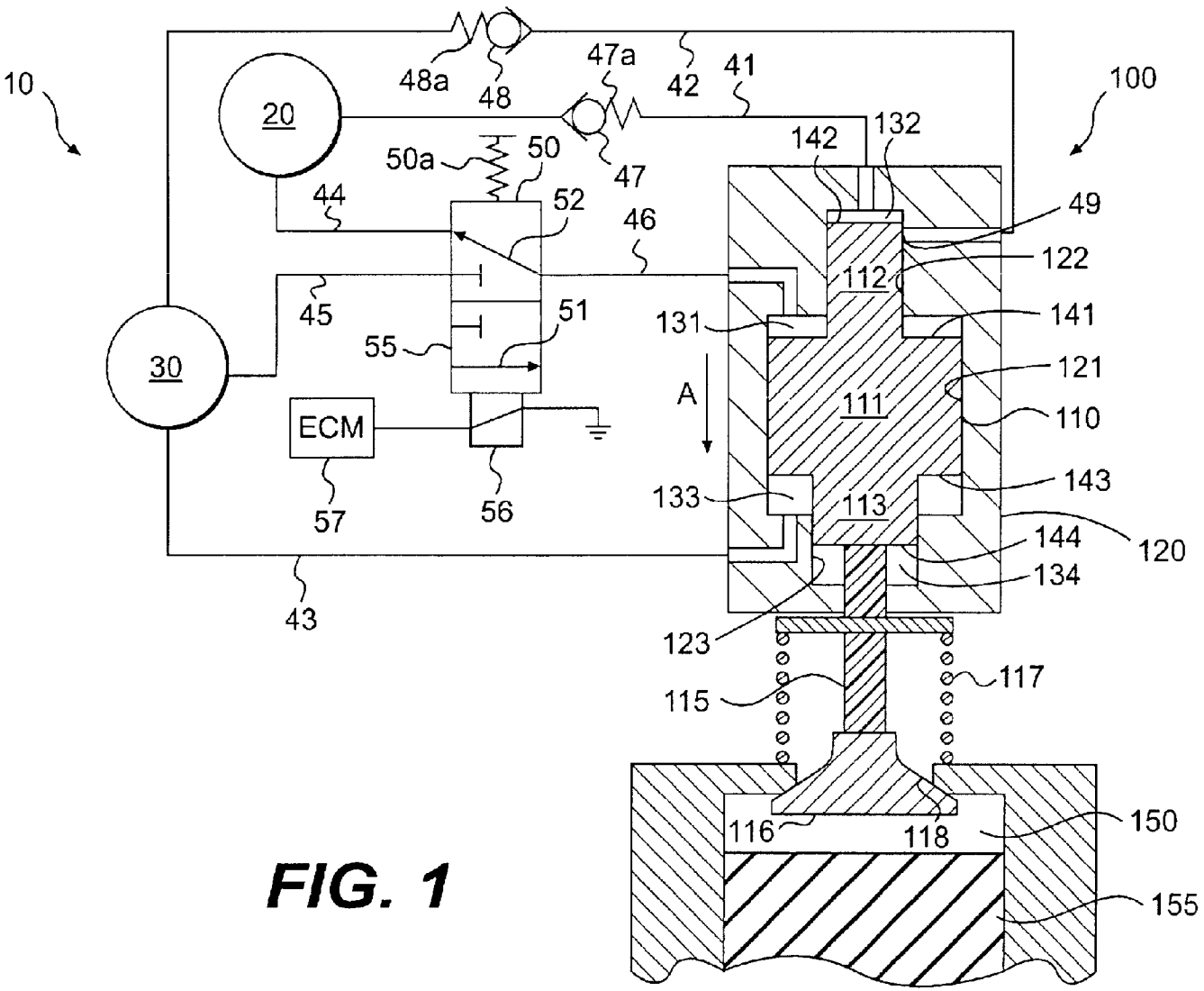
FIG. 1 is a schematic illustration of an embodiment of a valve actuation system of the present invention, showing a diagrammatic cross-sectional view of a valve actuation assembly with an actuation piston at a first position.

Referring to the drawings, a valve actuation system 10 includes a hydraulic valve actuation assembly 100 connected to a low pressure fluid source 20 and to a high pressure fluid source 30. Low pressure and high pressure, as used in this disclosure, are relative terms and are not meant to imply any absolute pressure ranges. Thus, low pressure fluid source 20 is at a lower pressure than high pressure fluid source 30. Both low pressure fluid source 20 and high pressure fluid source 30 may be part of engine fluid systems as known to persons of ordinary skill in the art. For instance, low pressure fluid source 20 may be a fluid source associated with an engine lubrication system and/or cooling system, operating, for instance, from 60 to 90 pounds per square inch (psi), and high pressure fluid source 30 may be a fluid source associated with a hydraulic lift system, an engine valve actuation system, or a fuel injector actuation system, operating, for instance, from 2000 to 4000 pounds per square inch (psi).

Hydraulic valve actuation assembly 100 has an actuation piston 110 and a housing or body 120. Body 120 has a bore 121, a bore 122, and a bore 123. Bores 121, 122, 123 are generally concentric and have cross-sections of differing diameters. For example, as shown in FIG. 1, the diameter of bore 121 is greater than the diameter of bore 122 and of bore 123. Body 120 may be made from multiple parts in order to ease the manufacturing and assembling of valve actuation assembly 100.

Figure 2:
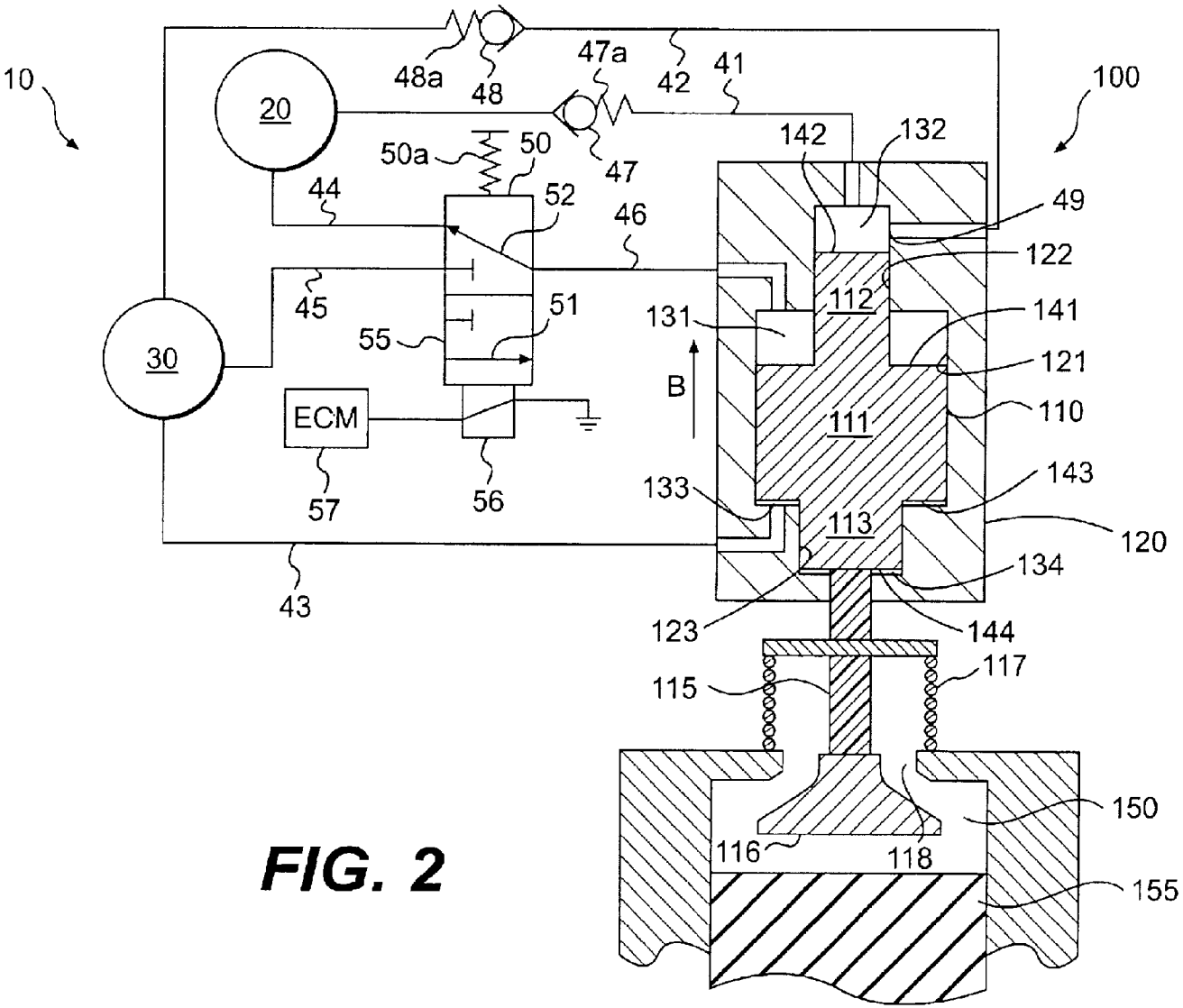
FIG. 2 is a schematic illustration of the valve actuation system of FIG. 1, showing the actuation piston at a second position.

Actuation piston 110 is slidably disposed in bores 121, 122, 123 and moves longitudinally back and forth within body 120. In a first direction as indicated by arrow A in FIG. 1, actuation piston 110 moves from a first position as shown in FIG. 1 to a second position as shown in FIG. 2. In a second direction as indicated by arrow B in FIG. 2, actuation piston 110 moves from the second position back to the first position.

As shown in FIGS. 1 and 2, actuation piston 110 includes a primary piston portion 111, a secondary piston portion 112, and a tertiary piston portion 113. Primary piston portion 111 slides within bore 121 and has a cross-section which complements the cross-section of bore 121. Similarly, secondary piston portion 112 slides within bore 122 and has a cross-section which complements the cross-section of bore 122, and tertiary piston portion 113 slides within bore 123 and has a cross-section which complements the cross-section of bore 123. Primary, secondary, and tertiary piston portions 111, 112, 113 may be formed as a single unit or these portions may be formed as separate units that are subsequently joined together.

Actuation piston 110 and body 120 may be formed of any suitable material or materials. Sealing methods that allow relative motion between actuation piston 110 and body 120 (not shown) may be located between the various portions of piston 110 and body 120.

Chambers 131, 132, 133, and 134, each defining a volume, are defined between actuation piston 110 and body 120. In the embodiment of FIGS. 1 and 2, chamber 131 and chamber 133 are within bore 121. Chamber 132 is within bore 122. Chamber 134 is within bore 123.

The volumes of chambers 131, 132, 133, and 134 vary depending upon the longitudinal position of actuation piston 110 relative to body 120. Referring to FIGS. 1 and 2, it can be seen that the volumes of chamber 131 and of chamber 132 increase when actuation piston 110 moves in the first direction (arrow A) and decrease when actuation piston 110 moves in the second direction (arrow B) back to the first position of actuation piston 110. The volumes of chamber 133 and chamber 134 decrease when actuation piston 110 moves relative to body 120 in the first direction (arrow A) and increase when actuation piston 110 moves in the second direction (arrow B).

Primary piston portion 111 has a surface area 141 associated with chamber 131. Secondary piston portion 112 has a surface area 142 associated with chamber 132.

Additionally, primary piston portion 111 has a surface area 143 associated with chamber 133. Tertiary piston portion 113 has a surface area 144 associated with chamber 134. In the embodiment of FIGS. 1 and 2, surface area 141 is greater than surface area 143. Surface area 143 is greater than surface area 142.

Low pressure fluid source 20 is connected to chamber 132 via a fluid passage 41. A check valve 47 is disposed within fluid passage 41. Check valve 47 is configured to allow the flow of fluid from low pressure fluid source 20 to chamber 132 when the pressure within source 20 is greater than the pressure within chamber 132, but to prohibit or block the flow of fluid from chamber 132 to low pressure fluid source 20. Check valve 47 may be biased in a closed position by spring element 47*a*.

As best shown in FIG. 2, high pressure fluid source 30 is connected to chamber 132 via a fluid passage 42. A check valve 48 is disposed within fluid passage 42. Check valve 48 allows the flow of fluid from chamber 132 to high pressure fluid source 30, and blocks the reverse flow of fluid from high pressure fluid source 30 to chamber 132. Check valve 48 may be biased in a closed position by spring element 48*a*.

High pressure fluid source 30 is connected to chamber 133 via a fluid passage 43.

A control valve 50 selectively connects low pressure fluid source 20 or high pressure fluid source 30 to chamber 131. Low pressure fluid source 20 is connected to control valve 50 via a fluid passage 44. High pressure fluid source 30 is connected to control valve 50 via a fluid passage 45. Control valve 50 is connected to chamber 131 via a fluid passage 46.

Chamber 134 may be vented, to atmosphere or to a lower pressure source, for instance, so that pressure does not build up within it during movement of actuation piston 110 relative to body 120. Venting may be accomplished, for example, by permitting leakage to occur between a valve stem 115 and body 120. Alternatively, a separate venting passage, discussed below, may be used to vent chamber 134.

As shown in FIG. 1, in a first position, control valve 50 provides a control valve fluid passage 52 connected to fluid passage 44 and connected to fluid passage 46. Control valve fluid passage 52 allows fluid to flow between low pressure fluid source 20 and chamber 131. In this first position, control valve 50 prohibits or blocks the flow of fluid between high pressure fluid source 30 and chamber 131.

As shown in FIG. 2, in a second position, control valve 50 provides a control valve fluid passage 51 connected to fluid passage 45 and connected to fluid passage 46. Control valve fluid passage 51 allows fluid to flow between high pressure fluid source 30 and chamber 131. In this second position, control valve 50 also prohibits or blocks the flow of fluid between low pressure fluid source 20 and chamber 131.

Control valve 50 may include a spool valve 55 actuated by a pilot valve 56. Pilot valve 56 may be actuated by a solenoid (not shown) or any other suitable electrical actuator, such as, for example, a piezoelectric actuator. Alternatively, spool valve 55 may be actuated directly by any of the suitable electrical devices, such as those mentioned. An electronic control module (ECM) 57 may be used to control the actuation of the pilot valve 56 or alternatively may directly control the actuation of control valve 50. Control valve 50 may be biased by a spring element 50*a* to either the first or second position. As shown in FIGS. 1 and 2, control valve 50 is biased to the first position.

As schematically shown in FIG. 1, a port 49 connects fluid passage 42 to chamber 132. When actuation piston 110 is in the first position and the volume of chamber 132 is at a minimum volume, actuation piston 110 blocks port 49 and fluid is prohibited from flowing within passage 42. Moreover, depending upon the placement of port 49 within bore 122 and the travel of actuation piston 110 within bore 122, port 49 may be blocked by actuation piston 110 prior to piston 110 reaching its first position. In other words, port 49 may be blocked by actuation piston 110 as piston 110 approaches its first position. Because actuation piston 110 is slidably movable within bore 122, actuation piston 110 may not completely seal port 49 and some fluid leakage may occur between actuation piston 110 and port 49. Thus, actuation piston 110 may substantially, but not completely, block port 49.

Figure 3:
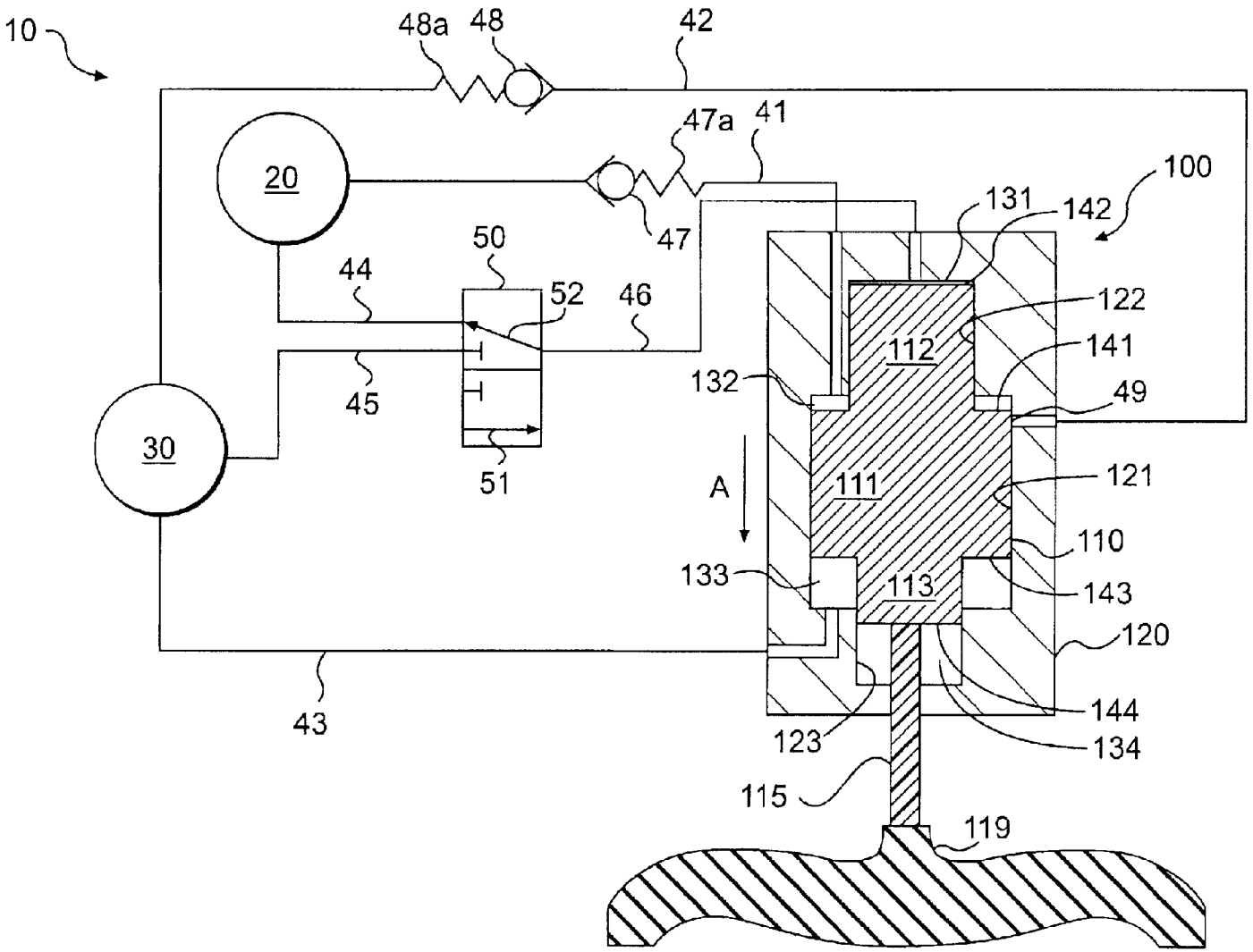
FIG. 3 is a schematic illustration of another embodiment of a valve actuation system of the present invention, showing a diagrammatic cross-sectional view of a valve actuation assembly.

Referring to FIGS. 1 and 2, actuation piston 110 may be connected to valve stem 115 which is attached to a valve element 116. Valve element 116 may be, for instance, the intake or exhaust valve element for the combustion chamber 150 of an internal combustion engine. Combustion chamber 150 is partially defined by combustion piston 155. Valve element 116 is configured to open and close combustion chamber 150 by engaging with and disengaging from a valve seat 118. In an alternative configuration as shown in FIG. 3, valve stem 115 may be attached to a valve bridge 119 for actuating a plurality of valve elements (not shown). Valve element 116 may be any device known to persons of ordinary skill in the art to selectively block an intake or exhaust passageway in an engine.

A spring element 117 may be used to bias valve element 116 against valve seat 118, thus closing the intake or exhaust passage of combustion chamber 150. Spring element 117 may be located between valve element 116 and valve seat 118 as shown, for instance, in FIG. 1. Spring element 117 may be alternatively located, for instance, between actuation piston 110 and body 120 (not shown), thereby remotely biasing valve element 116 against valve seat 118.

In an alternative exemplary embodiment, as shown in FIG. 3, the relative location of chamber 131 and chamber 132 within body 120 may be transposed. In other words, chamber 132 may be associated with surface area 141 of primary piston portion 111, and chamber 131 may be associated with surface area 142 of secondary piston portion 112. Chamber 133 is still associated with surface area 143 of primary piston portion 111. As with the first exemplary embodiment, the surface area associated with chamber 131 is greater than the surface area associated with chamber 133, and the surface area associated with chamber 133 is greater than the surface area associated with chamber 132. In the embodiment of FIG. 3, surface are 142 is now associated with chamber 131, surface area 141 is now associated with chamber 132, and surface area 143 is still associated with chamber 133. Thus, for this embodiment, surface area 142 is greater than surface area 143, which is greater than surface area 141.

Figure 4:
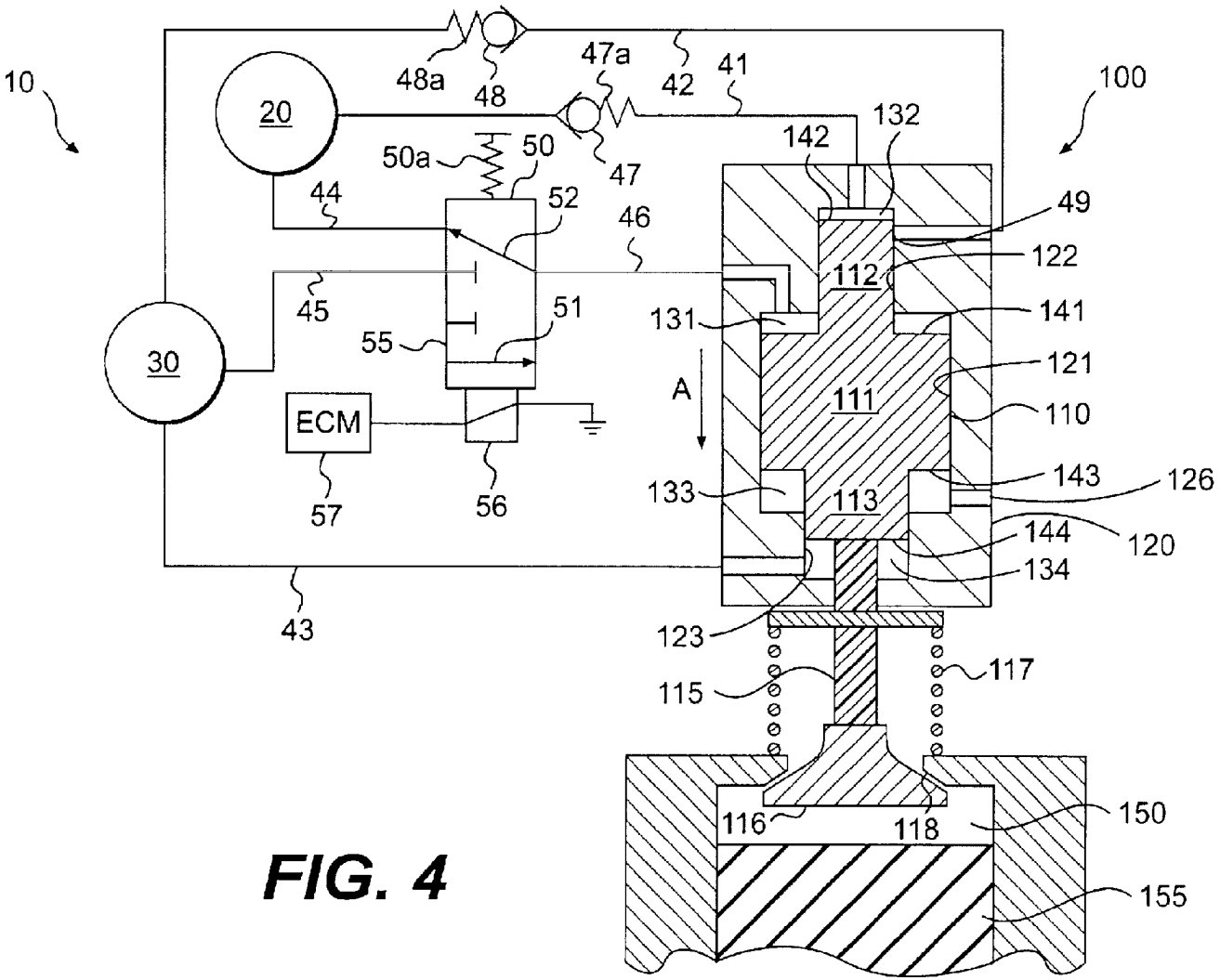
FIG. 4 is a schematic illustration of another embodiment of a valve actuation system of the present invention, showing a diagrammatic cross-sectional view of a valve actuation assembly.

In another alternative exemplary embodiment, as shown in FIG. 4, high pressure fluid source 30 is connected to chamber 134 via fluid passage 43. Chamber 133 is vented via venting passage 126 to prevent pressure from building up within it during movement of actuation piston 110 relative to body 120. In this embodiment, surface area 141 is greater than surface area 144 and surface area 144 is greater than surface area 142.

Figure 5A:
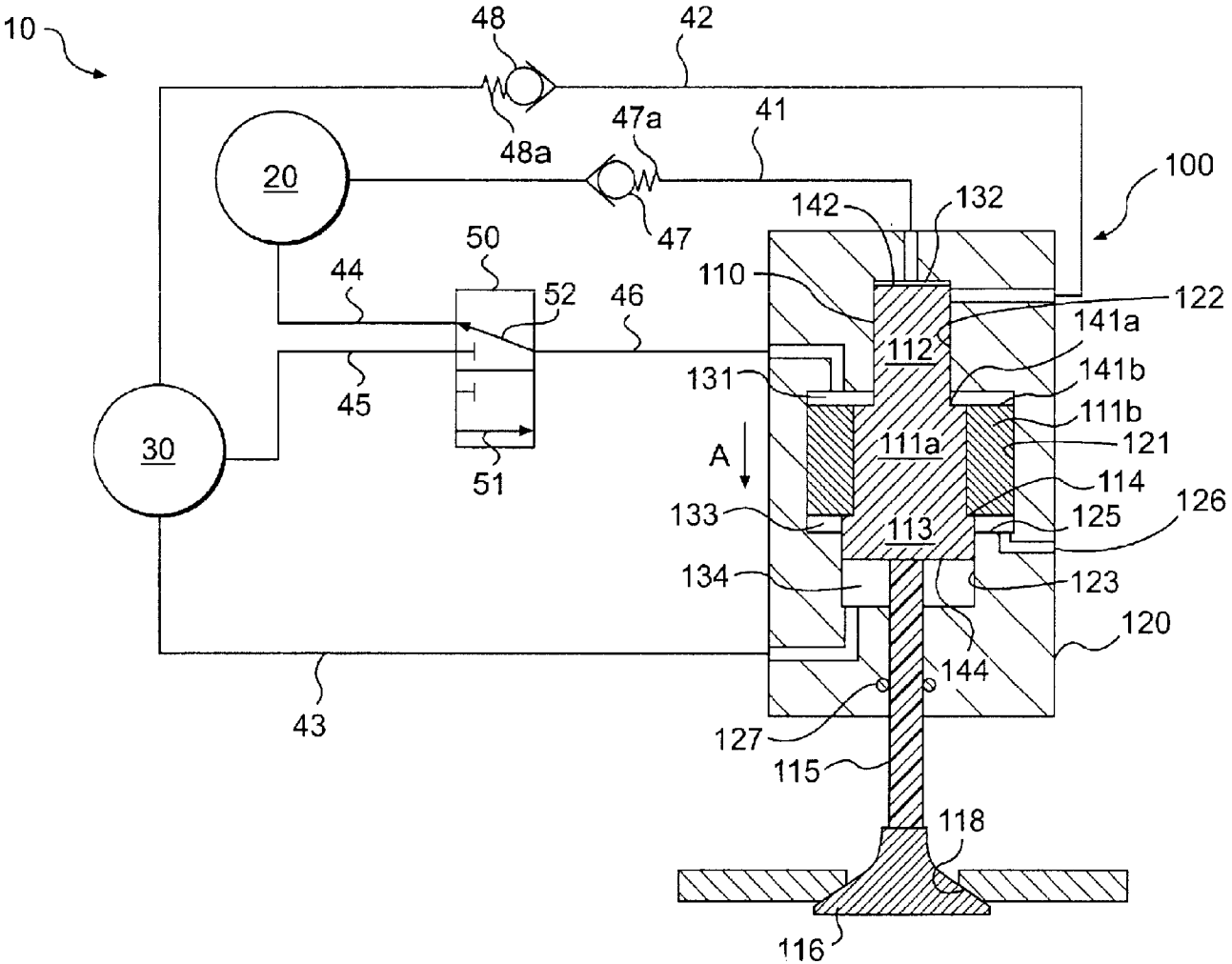
FIG. 5*a* is a schematic illustration of another embodiment of a valve actuation system of the present invention, showing a diagrammatic cross-sectional view of a valve actuation assembly with an actuation piston at a first position.
Figure 5B:
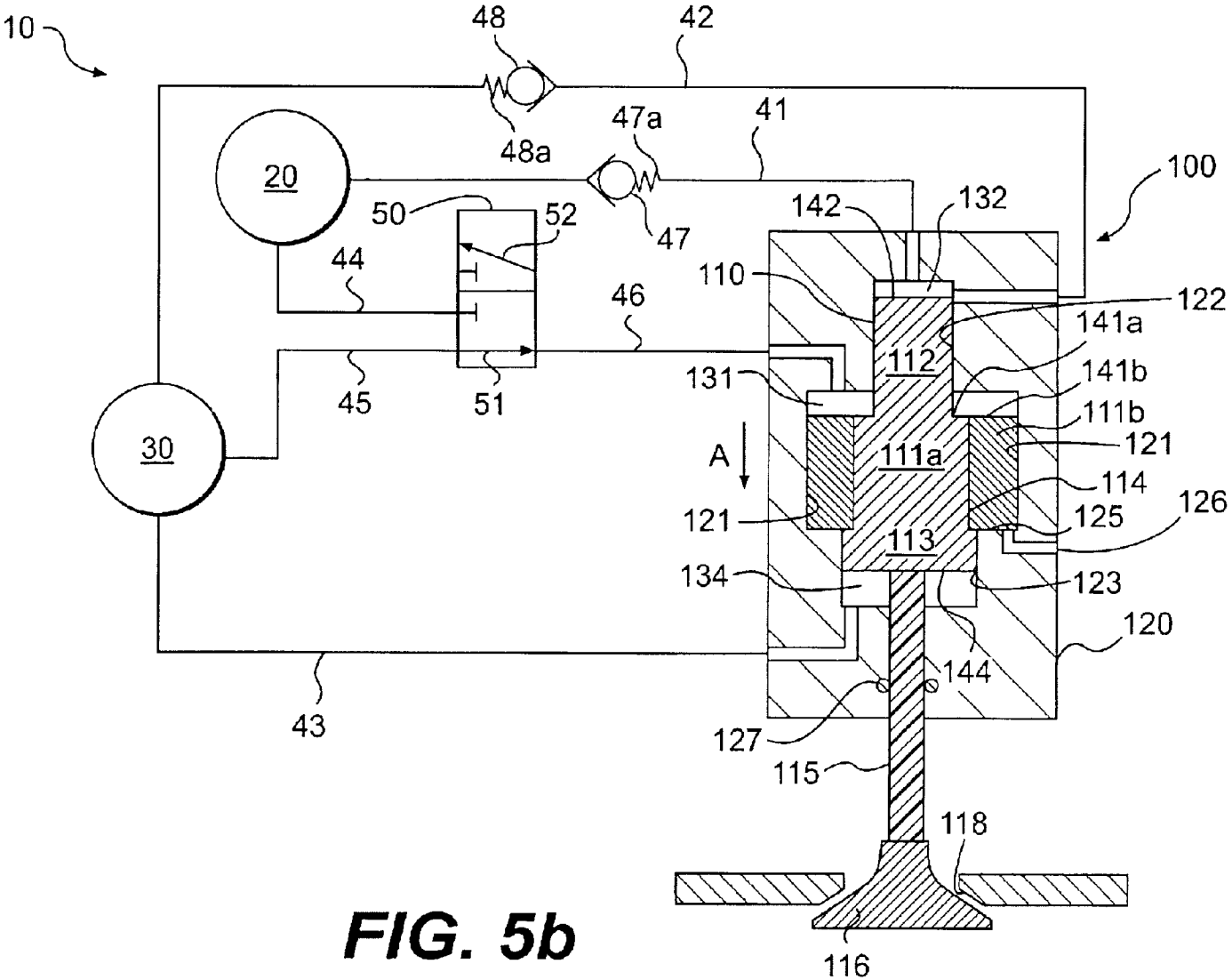
FIG. 5*b* is a schematic illustration of the valve actuation system of FIG. 5*a*, showing the actuation piston at a second position.
Figure 5C:
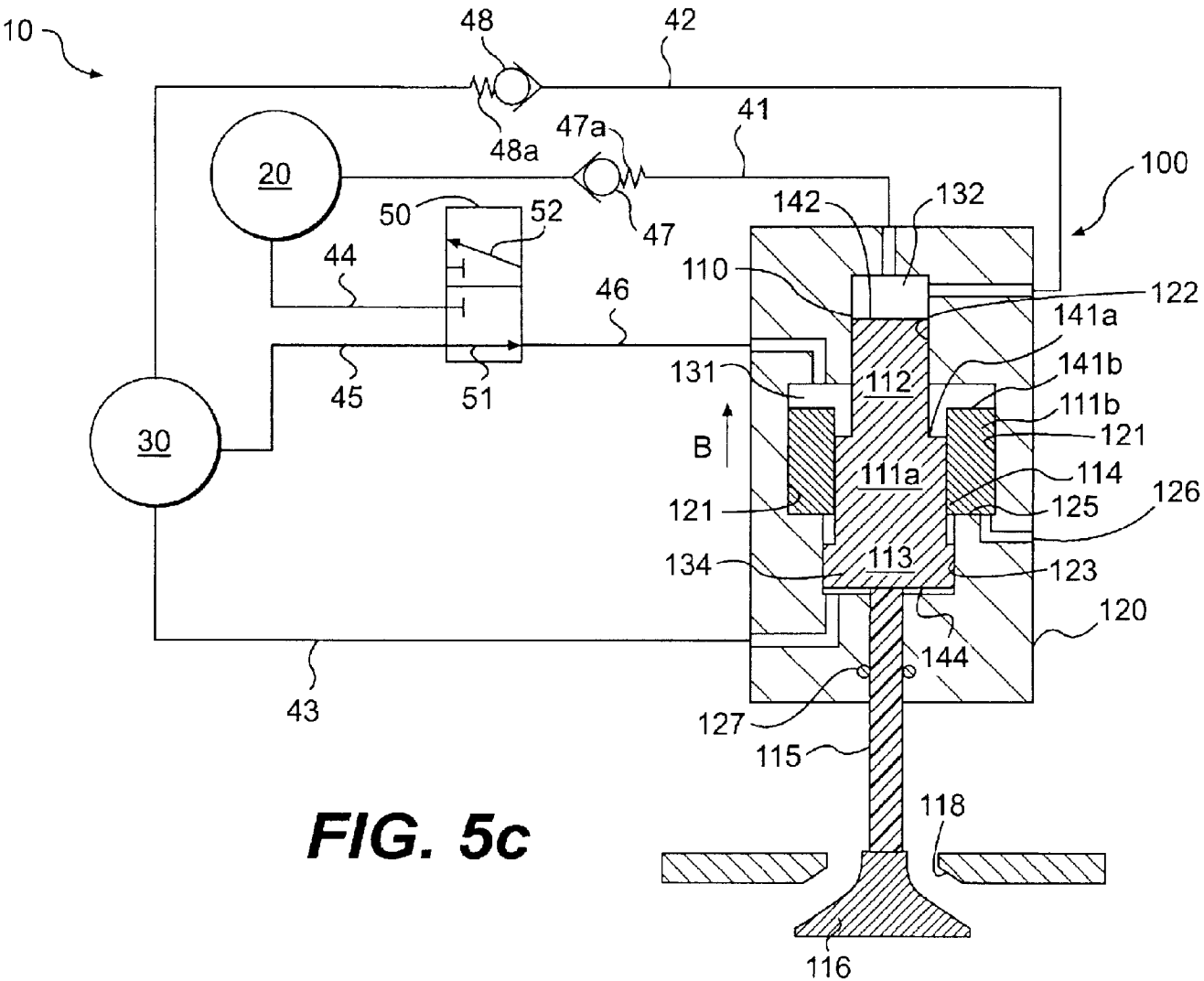
FIG. 5*c* is a schematic illustration of the valve actuation system of FIG. 5*a*, showing the actuation piston at a third position.

In a further exemplary embodiment as shown in FIGS. 5*a*, 5*b*, and 5*c*, primary piston portion 111 may have a first member 111*a* and a second member 111*b*. Second member 111*b* is linearly movable relative to first member 111*a*. Second member 111*b* slides within bore 121; first member

111*a* slides within second member 111*b*. Secondary piston portion 112 slides within bore 122. Tertiary piston portion 113 slides with bore 123.

First and second members 111*a* and 111*b* are configured to allow for joint movement of both first and second members 111*a* and 111*b* relative to bore 121 and for individual movement of second member 111*b* relative to first member 111*a*. First member 111*a* includes a shoulder 114 that is configured to engage second member 111*b*. Body 120 includes a stop 125 that is also configured to engage second member 111*b*.

First member 111*a* has a surface area 141*a* associated with chamber 131. Second member 111*b* has a surface area 141*b* also associated with chamber 131. Secondary piston portion 112 has a surface area 142 associated with chamber 132. Second member 111*b* of primary piston portion 111 has a surface area 143 associated with chamber 133. Tertiary piston portion 113 has a surface area 144 associated with chamber 134. Surface area 144 is greater than surface area 142 and is less than surface area 141*a*.

As shown in FIGS. 5*a*–5*c*, chamber 133 is vented, for instance, to atmosphere through venting passage 126, so that pressure does not build up within it during movement of actuation piston 110 relative to body 120. Also as shown in FIGS. 5*a*–5*c*, one or more valve stem seals 127 may be located between valve stem 115 and body 120 in order to prevent fluid from leaking past valve stem 115 from chamber 134. Other seals (not shown) may be used, as appropriate and as known by persons of ordinary skill in the art, to prevent unwanted leakage between chambers or anywhere else in the system.

INDUSTRIAL APPLICABILITY

As will be apparent from the foregoing description, the present invention provides a hydraulic valve actuation system 10. Valve actuation system 10 may provide a variable force to lift and/or lower valve element 116 based on the flow of pressurized fluids. In addition, valve actuation system 10 may provide for controlled velocity of valve element 116.

Valve actuation system 10 may be implemented into any type of internal combustion engine, such as, for example, a diesel engine, a gasoline engine, or a natural gas engine. Moreover, valve actuation system 10 may be used to actuate an individual valve element 116 or a plurality of valve elements 116 via actuation of a valve bridge 119.

Hydraulic valve actuation system 10 of FIG. 1 may be adapted for controlling the intake or exhaust of gases to and from a combustion chamber 150 of an engine. One exemplary use of the invention could be in a vehicle that is provided with a diesel engine coupled to a low pressure oil system for lubricating and cooling the engine and to a high pressure oil system for actuating hydraulically actuated fuel injectors. Thus, low pressure fluid source 20 may be low pressure oil source 20 and high pressure fluid source 30 may be high pressure oil source 30.

For instance, hydraulic valve actuation system 10 may include valve stem 115 attached to valve element 116. Valve element 116 has a profile which complements the profile of valve seat 118 of combustion chamber 150. Timed actuation of system 10 provides relative movements between valve element 116 and valve seat 118 and the ability to intake gases into or exhaust gases from the combustion chamber 150 at select times during the combustion cycle.

As best shown in FIG. 1, prior to the beginning of the intake or exhaust stroke of the combustion pistons 155 of the internal combustion engine, actuation piston 110 may be provided in a first position such that the volume of chamber 132 is minimized and valve element 116 is seated within valve seat 118, sealing combustion chamber 150.

Prior to the beginning of the stroke, control valve is in a first position, as shown in FIG. 1, wherein control valve 50 allows the flow of fluid between low pressure oil source 20 and chamber 131, via control valve fluid passage 52, and blocks the flow of fluid from between high pressure oil source 30 and chamber 131. Thus, the pressure in chamber 131 is at the same pressure as the pressure in the low pressure oil system. High pressure oil source 30 is connected to chamber 133, and thus, the pressure in chamber 133 is at the same pressure as the pressure in the high pressure oil system. The pressure in chamber 132 may have bled down to the same pressure in chamber 131, and thus, the pressure in chamber 132 may be at the same pressure as the pressure in low pressure oil source 20.

At the beginning of the stroke, electric current is provided to a solenoid (not shown) which activates pilot valve 56. Activation of pilot valve 56 in turn causes control valve 50 to move from its first position to its second position (as shown in FIG. 2). High pressure oil from source 30 flows into chamber 131 via control valve passage 51. When the high pressure oil is introduced into chamber 131, the pressurized oil exerts a force on surface area 141 of piston portion 111. Surface area 141 of piston portion 111, which is associated with chamber 131, is greater than surface area 143 of piston portion 111, which is associated with chamber 133. Thus, the high pressure oil entering chamber 131 pushes actuation piston 110 in a first direction (arrow A) against the back pressure of the oil in chamber 133. If spring element 117 is present, the force exerted by the oil in chamber 131, in addition to overcoming the back pressure of chamber 133, also overcomes the opposing force of spring element 117 to move or "lift" valve element 116 away from valve seat 118. Combustion gases may then enter or exit combustion chamber 150. Furthermore, if there is any back pressure in combustion chamber 150 itself, the force initially exerted by the oil in chamber 131 must also overcome the force due to the combustion chamber 150 back pressure acting on valve element 116.

The force exerted by the pressurized oil on actuation piston 110 and valve element 116 is dependent, at least in part, upon surface areas 141 and 143 and the pressure of the pressurized oil. The generated force may be increased by increasing the area of surface area 141 or decreasing the area of surface area 143.

As actuation piston 110 moves in first direction (arrow A) the volumes of chambers 131 and 132 increase and the volumes of chambers 133 and 134 decrease. As the volume of chamber 133 decreases, the pressure in this chamber 133 starts to exceed the pressure within high pressure oil source 30. As a result, oil is passed from chamber 133 to high pressure oil source 30 via fluid passage 43. As the volume of chamber 134 decreases, any oil or air within the chamber is vented, either via leakage between valve stem 115 and body 120 or via a venting passage (not shown), in order to prevent the build-up of pressure within chamber 134.

In addition, as the volume of chamber 132 increases, the pressure within this chamber 132 decreases and falls below the pressure in low pressure oil source 20. Check valve 47 opens and oil is passed from low pressure oil source 20 into chamber 132 via fluid passage 41.

When actuation piston 110 reaches its second position, as shown in FIG. 2, and valve element 116 reaches its full lift position, control valve fluid passage 51 is closed and the flow of oil from high pressure oil source 30 into chamber 131 is stopped. For example, if control valve 50 includes pilot valve 56 for actuating spool valve 55, then as actuation piston 110 approaches its second position, which corresponds to the full lift position of valve element 116, pilot valve 56 is deactivated and spool valve 55 slowly returns to its default position. In its default configuration, control valve fluid passage 51 is closed and control valve fluid passage 52 is open. Thus, the supply of oil from high pressure oil source 30 to chamber 131 is cut off and chamber 131 becomes flow-connected to low pressure oil source 20.

The resulting loss of pressure in chamber 131 allows the pressure of chamber 133 to push actuation piston 110 from its second position back to its first position, i.e., in the second direction (arrow B). At the same time, oil flows from chamber 131 into low pressure oil source 20, the volumes of chambers 131 and 132 decrease, and the volumes of chambers 133 and 134 increase.

As actuation piston 110 moves in the second direction (arrow B), valve element 116 moves toward valve seat 118. The oil within chamber 132, which had been at the pressure of low pressure oil source 20, increases, and this increase in pressure within chamber 132 causes check valve 47 to close. As actuation piston 10 continues to move in the second direction, the pressure within chamber 132 continues to increase, eventually starting to exceed the pressure within high pressure oil source 30. At this time, check valve 48 opens and oil flows from chamber 132 to high pressure oil source 30 via fluid passage 42. In this manner, the high pressure oil system recuperates part of its hydraulic energy.

In addition, as actuation piston 110 continues to approach its first position and valve element 116 continues to approach valve seat 118, the opening or port 49 of fluid passage 42 into chamber 132 becomes covered and blocked, or substantially blocked, by secondary piston portion 112. Flow from chamber 132 to high pressure oil source 30 ceases. However, because the volume of chamber 132 is still decreasing, the pressure in chamber 132 continues to increase, eventually exceeding the pressure in high pressure oil source 30. This pressurized oil in chamber 132 limits the force with which actuation piston 110 approaches its first position, thus limiting the force with which valve element 116 is seated against valve seat 118.

At the end of the intake or exhaust actuation cycle, with actuation piston 110 approaching its first position, the pressurized oil within chamber 132 may bleed-down to the low pressure oil within chamber 131, which is still flow-connected to low pressure oil source 20. This bleed-down may occur via flow between secondary piston portion 112 and bore 122. The flow between secondary piston portion 112 and bore 122 may be due, for example, to leakage, to a piston-bore annular clearance, or to a groove machined into either piston portion 112 or bore 122. This leakage or bleed-down between the secondary piston portion 112 and bore 122 reduces the pressure in chamber 132 and allows controlled return of actuation piston 110 to its first position in response to the pressure within chamber 133. Hydraulic valve actuation system 10 is now positioned to begin another intake or exhaust actuation cycle.

In the alternative embodiment shown in FIGS. 5*a*, 5*b*, and 5*c*, actuation piston 110 includes first member 111*a* and second member 111*b*. Second member 111*b* is selectively linearly movable relative to first member 111*a*. For instance, when control valve 50 is first actuated at the beginning of an intake or exhaust actuation cycle and high pressure oil enters chamber 131, both surface area 141*a* and surface area 141*b* are exposed to high pressure oil. This pressure causes first and second members 111*a*, 111*b* to move together at a first force in the first direction, as shown in FIG. 5*a*. In addition, the engagement of second member 111*b* with shoulder 114 of first member 111*a* causes first and second members 111*a*, 111*b* to move together when movement in the first direction is first initiated. Thus, the contribution of the high pressure oil in chamber 131 acting on both first and second members 111*a*, 111*b* may be used to unseat valve element 116 from valve seat 118. This provides a maximum force for unseating valve element 116, which may be desired, for example, when a significant combustion chamber 150 back pressure exists.

First and second members 111*a*, 111*b* move together in the first direction (arrow A) until second member 111*b* engages stop 125, as best shown in FIG. 5*b*. Stop 125 prevents further movement of second member 111*b*. The pressurized oil within chamber 131 continues to exert a force on first member 111*a*, and so, first member 111*a* continues to move in the first direction, as best shown in FIG. 5*c*. However, the force acting to move actuation piston 110 in the first direction is now decreased, as the force which acts upon second member 111*b* no longer acts to move actuation piston 110 in the first direction. Thus, although first member 111*a*, actuation piston 110 and valve element 116 continue to move in the first direction until reaching the second position, as best shown in FIG. 5*c*, they do so with a reduced force. When movement of piston 110 is reversed (arrow B), first member 111*a* moves relative to second member 111*b* until shoulder 114 of first member 111*a* engages second member 111*b*, at which time second member 111*b* moves jointly with first member 111*a*.

The configuration shown in FIGS. 5*a*–5*c* would typically require less high pressure oil to fully open valve element 116 relative to valve seat 118 as compared to the configuration shown in FIGS. 1 and 2, all other things being equal. Thus, the amount of high pressure oil pulled from high pressure oil source may be minimized and the overall efficiency of the high pressure oil system may be improved.

What is claimed is:

1. An engine valve actuation system, comprising:

an actuation assembly having a body, a piston slidable relative to the body, and first, second, and third chambers defined between the piston and the body;

a low pressure fluid source;

a first fluid passage configured to connect the low pressure fluid source to the second chamber;

a high pressure fluid source;

a second fluid passage configured to connect the high pressure fluid source to the second chamber to allow the fluid to flow from the second chamber to the high pressure fluid source;

a third fluid passage configured to connect the high pressure fluid source to the third chamber; and a control valve connected to the low pressure fluid source, to the high pressure fluid source, and to the first chamber, the control valve configured to move between a first position at which the high pressure fluid source is connected to the first chamber and a second position at which the low pressure fluid source is connected to the first chamber.

2. The system of claim 1, further comprising first and second check valves disposed within the first and second fluid passages, respectively, the first check valve configured to block the flow of fluid from the second chamber to the low pressure fluid source and the second check valve configured to block the flow of fluid from the high pressure fluid source to the second chamber.

3. The system of claim 2, further including a valve stem connected to the piston, the valve stem connected to a valve element.

4. The system of claim 3, further including a spring to bias the piston relative to the body such that the valve element is biased in a closed position.

5. The system of claim 2, wherein the piston is connected to a valve bridge to actuate a plurality of valve elements.

6. The system of claim 1, wherein the first and second chambers have volumes that increase and the third chamber has a volume that decreases in response to the piston moving relative to the body in a first direction, and the piston includes a first surface area associated with the first chamber, a second surface area associated with the second chamber, and a third surface area associated with the third chamber.

7. The system of claim 6, wherein the first surface area is greater than the third surface area, and the third surface area is greater than the second surface area.

8. The system of claim 1, wherein the piston includes a first member and a second member, the second member being linearly movable relative to the first member.

9. The system of claim 8, wherein the volumes of the first and second chambers increase and the volume of the third chamber decreases in response to the piston moving relative to the body in a first direction, wherein the piston includes a first surface area associated with the first chamber, a second surface area associated with the second chamber, and a third surface area associated with the third chamber, and wherein the first surface area includes first and second member surface areas associated with the first and second members, respectively.

10. The system of claim 9, wherein the first member and the second member move together in response to the piston moving in the first direction until the second member engages a stop.

11. The system of claim 1, wherein the control valve includes a spool valve actuated by a pilot valve.

12. The system of claim 1, wherein the piston is in a first position in response to the second chamber being at a minimum volume, and wherein the second fluid passage is substantially blocked in response to the piston being in the first position.

13. The system of claim 12, wherein the second fluid passage is substantially blocked by the piston in response to the piston approaching the first position.

14. A method to operate a valve actuation system, the valve actuation system having a piston, a body, first, second, and third chambers defined between the piston and the body, a low pressure fluid source selectively connected to the first and second chambers, and a high pressure fluid source selectively connected to the first and second chambers and connected to the third chamber, the method comprising:

providing the piston in a first position such that the volume of the second chamber is minimized;

passing a flow of fluid from the high pressure fluid source to the first chamber;

moving the piston in the first direction;

passing fluid from the third chamber to the high pressure fluid source in response to the pressure in the third chamber exceeding the pressure in the high pressure fluid source; and passing fluid from the low pressure fluid source into the second chamber in response to the pressure in the second chamber being less than the pressure in the low pressure fluid source.

15. The method of claim 14, further comprising:

stopping the flow of fluid from the high pressure fluid source into the first chamber;

passing fluid from the first chamber into the low pressure fluid source;

moving the piston in a second direction opposite the first direction; and passing fluid from the second chamber to the high pressure fluid source in response to the pressure in the second chamber exceeding the pressure in the high pressure fluid source.

16. The method of claim 15, further including substantially blocking the second fluid passage in response to the piston being substantially in the first position.

17. The method of claim 16, further including passing fluid from the second chamber to the first chamber via flow between the piston and the body.

18. The method of claim 14, wherein the piston includes a first member and a second member, the second member being linearly movable relative to the first member, and further including:

passing fluid from the high pressure fluid source to the first chamber;

moving the first and second members together with a first force in the first direction until the second member engages a stop; and moving the first member relative to the second member in the first direction with a second force, which is less than the first force.

19. A method to recover energy in an engine valve actuation system connected to a high pressure fluid source, the engine valve actuation system including a body, a piston capable of moving relative to the body, and first, second, and third volumes defined between the piston and the body, the method comprising:

moving the piston relative to the body in a first direction in response to passing fluid from the high pressure fluid source to the first volume;

passing fluid from the second volume to the high pressure fluid source in response to moving the piston relative to the body in the first direction;

moving the piston relative to the body in a second direction opposite the first direction in response to draining fluid from the first volume and passing fluid from the high pressure fluid source to the second volume; and passing fluid from the third volume defined between the piston and the body into the high pressure fluid source in response to moving the piston relative to the body in the second direction.

20. The method of claim 19, wherein draining fluid from the first volume includes passing fluid from the first volume into a low pressure fluid source.

21. A method to control a closing force of a valve in an engine valve actuation system connected to a high pressure fluid source, the engine valve actuation system including a body, a piston capable of moving relative to the body, and first, second, and third volumes defined between the piston and the body, the method comprising:

moving the piston relative to the body in a valve-closing direction in response to passing fluid from the high pressure fluid source into the first volume;

decreasing the closing force of the valve in response to increasing the pressure in a second volume;

passing fluid from the second volume to the high pressure fluid source in response to the pressure in the second volume exceeding the pressure in the high pressure fluid source;

further decreasing the closing force of the valve in response to blocking the passing of fluid from the second volume to the high pressure fluid source; and decreasing the pressure in the second volume in response to passing fluid from the second volume to the third volume defined between the piston and the body.

* * * * *